United States Patent [19]

Schaefer

[11] 4,196,579

[45] Apr. 8, 1980

[54] MECHANICALLY OPERATING PENDULUM CLOCK WITH AN ELECTRONIC CORRECTING DEVICE

[75] Inventor: Konrad Schaefer, Trossingen, Fed. Rep. of Germany

[73] Assignee: Urgos Uhrenfabrik Schwenningen, Haller, Jauch und Pabst GmbH & Co., Fed. Rep. of Germany

[21] Appl. No.: 955,556

[22] Filed: Oct. 27, 1978

[30] Foreign Application Priority Data

Nov. 2, 1977 [DE] Fed. Rep. of Germany ..... 2749006

[51] Int. Cl.[2] ..... G04C 3/02; G04B 17/02

[52] U.S. Cl. ..... 368/181; 368/165

[58] Field of Search ..... 58/23 R, 23 A, 23 D, 58/28 R, 29–31, 129, 132, 133; 318/126–130; 331/116 M

[56] References Cited

U.S. PATENT DOCUMENTS

| | | | |
|---|---|---|---|
| 3,806,781 | 4/1974 | Berney | 318/130 |
| 3,818,376 | 6/1974 | Keller et al. | 331/116 M |
| 3,921,386 | 11/1975 | Keller | 58/28 R |
| 3,952,497 | 4/1976 | Schulz et al. | 58/28 R |
| 4,036,006 | 7/1977 | Effenberger et al. | 58/23 R |
| 4,106,280 | 8/1978 | Schulz et al. | 58/28 R |

*Primary Examiner*—Vit W. Miska

*Attorney, Agent, or Firm*—Steele, Gould & Fried

[57] ABSTRACT

A mechanically operating pendulum clock is provided with an electronic correcting device which comprises a quartz oscillator. An electronic frequency divider generates from the oscillation frequency of the quartz oscillator a frequency equal to that of the pendulum. A permanent magnet is arranged on the pendulum to cooperate with a control coil forming an electro-mechanical converter. The control coil is effective at least in the two turning positions of the pendulum. A contact-free pendulum sensor is also provided. A proportional electronic control device includes a converter which produces rectangular signals from the signals emitted by the quartz oscillator and the sensor, and a comparator is adapted, depending upon the reciprocal phase position of the quartz oscillator and sensor signals to transmit delay or acceleration signals to the control coil as well as opposing acceleration or delay signals to the control coil but phase-shifted by 180°.

6 Claims, 2 Drawing Figures

MECHANICALLY OPERATING PENDULUM CLOCK WITH AN ELECTRONIC CORRECTING DEVICE

FIELD OF THE INVENTION

The invention relates to a mechanically operating pendulum clock with an electronic correcting device. The correcting device comprises a quartz oscillator, an electric frequency divider which divides the frequency of oscillation of the quartz oscillator to produce the same frequency as the pendulum, an electro-mechanical converter with an electro-magnet and a permanent magnet arranged on the pendulum, and a proportional electronic control arrangement containing a comparator.

BACKGROUND OF THE INVENTION

A pendulum clock of the type described above is known from German Auslegeschrift No. 2,353,200 as well as from the journal "Uhren-Journal" 3/76. In that pendulum clock, so-called two-step action control takes place, i.e. the control begins when the necessary correction has exceeded or fallen below a limit value of, for example, 0.7 seconds. A certain amount of inaccuracy thus has to be tolerated.

The comparator functions in analog fashion and comprises two control coils arranged on opposite sides of the pendulum.

OBJECT OF THE INVENTION

An object of the invention is to provide a pendulum clock of the above type in which the correction device operates with less effort and greatly improved accuracy.

BRIEF SUMMARY OF THE INVENTION

According to the invention there is provided a mechanically operating pendulum clock provided with an electronic correcting device which comprises a quartz oscillator; an electronic frequency divider which generates, from the oscillation frequency of the quartz oscillator, a frequency equal to that of the pendulum; a permanent magnet arranged on the pendulum; a control coil forming an electro-mechanical converter with an electro-magnet, the control coil being effective at least in the two turning positions of the pendulum; a contact-free pendulum sensor; and a proportional electronic control device having a converter which produces rectangular signals from the signals emitted by the quartz oscillator and the sensor, and a comparator which is adapted, depending upon the reciprocal phase position of the quartz oscillator and sensor signals to transmit delay or acceleration signals to the control coil as well as opposing acceleration or delay signals to the control coil but phase-shifted by 180°.

The proportional control device operates with digital phase comparison, in such a way that a correction is made immediately after the slightest deviation occurs. A particular advantage lies in the fact that an acceleration signal is followed by a delay signal offset by 180° in each case and vice-versa. This phenomenon, which occurs incidentally as a result of the digital correcting device, is made use of owing to the particular design and arrangement of the control coil which acts at both turning positions of the pendulum, so that no unsymmetrical correcting force is applied to the pendulum. Nevertheless, a control coil can be used.

The control coil preferably has an axial length such that the permanent magnet extending into it remains in its immediate vicinity throughout the entire movement of the pendulum. A gentle application of force is thus ensured with the greatest efficiency.

A disconnecting device which makes the correcting device ineffective when the pendulum is stationary is provided in a particularly preferred embodiment of the invention. If this were not done, when the pendulum was stationary, the correcting device would emit a continuous acceleration signal which would, however, be ineffective. A relatively large amount of energy would therefore be consumed. The disconnecting device ensures that the correcting device can also be operated, for example, with a battery, without this discharging rapidly when the pendulum is stationary.

The disconnecting device is preferably arranged in such a way that it disconnects the quartz oscillator or its current supply, but leaves the rest of the correcting device in readiness for operation. The correcting device can thus detect when the pendulum starts up again and can operate again immediately without manual intervention being necessary.

The disconnecting device advantageously contains an integrating member which causes the current supply of the quartz oscillator to be disconnected if the pendulum pulses are absent for a relatively long period.

Other advantages and features of the invention are disclosed in the description in conjunction with the drawings. An embodiment of the invention is shown in the drawings and is described in more detail below.

DETAILED DESCRIPTION OF PREFERRED EMBODIMENTS

Figure 1:
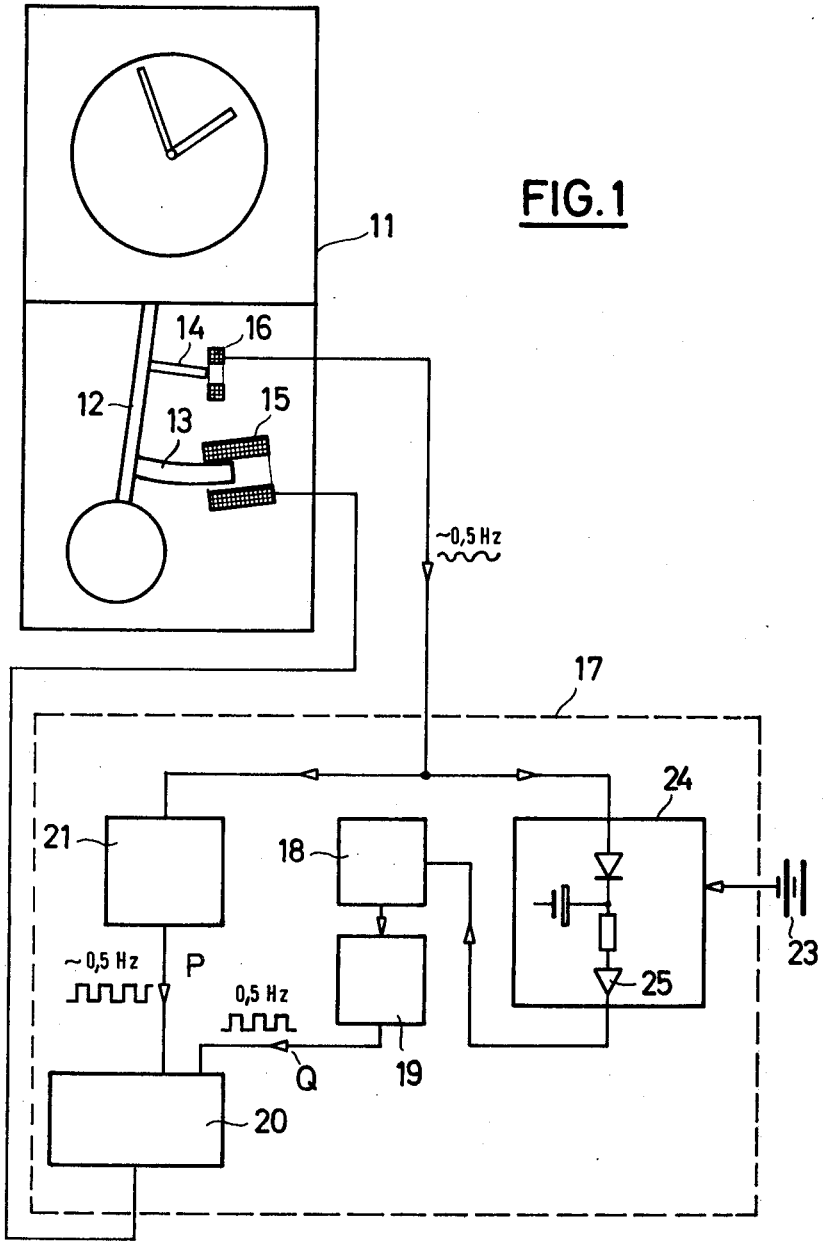
FIG. 1 shows a diagrammatic illustration of a pendulum clock with a block circuit diagram of the electronic correcting device.

FIG. 1 shows a mechanically operating pendulum clock 11, which has two rod-shaped permanent magnets 13 and 14 on its pendulum 12. The permanent magnet 13 projects into a control coil 15 while the permanent magnet 14 projects into a sensor coil 16. The coils, and in particular the control coil 15, are axially dimensioned in such a way that, throughout the entire movement of the pendulum, the permanent magnet remains in its immediate vicinity. For this purpose, both the permanent magnet and the coil have relatively large axial dimensions in the present case. However, it is alternatively possible for only one of the two to be provided with these axial dimensions.

In order to simplify the illustration, two separate magnets are arranged on the same side of the pendulum. The two coils could however be arranged on one side of the pendulum and the permanent magnets could, if desired, be combined. It is also possible to alter the spatial arrangement of the two coils in relation to each other, but the functioning of the sensor coil and control coil should remain separate.

The sensor coil 16 produces, in coordination with the permanent magnet 14, a sinusoidal pendulum pulse which has a frequency of 0.5 Hertz in the case of a "second pendulum".

The clock 11 is provided with an electronic correcting device 17. Since the correcting device can be produced as a very simple and small structure, it can normally be easily spatially integrated in a pendulum clock. The electronic correcting device 17 comprises a quartz oscillator 18, for example a conventional commercial quartz oscillator of 4.19 MHz, to which is connected an electronic frequency divider 19 which generates from the initial frequency of the quartz oscillator 18 a frequency corresponding to the frequency of the pendulum. The divider 19 emits a rectangular pulse. Thus, in the example given above it emits a rectangular pulse of 0.5 Hz.

This pulse, designated as the quartz pulse Q, is fed to a comparator 20. The comparator 20 also receives a pendulum pulse P which is produced by an amplifier/-trigger 21 from the original pendulum pulse produced by the sensor coil 16. This pendulum pulse P is also present at the comparator in the form of a rectangular pulse which, when the clock is going accurately, has the same frequency as the quartz pulse Q.

A digital phase comparison between the pendulum pulse P and the quartz pulse Q is made in the comparator 20. The comparator produces delay pulses V and acceleration pulses B which are fed to the control coil 15 and which there exert a corresponding attracting or repelling effect on the permanent magnet 13 and thus on the pendulum 12.

With this arrangement, the comparator satisfies the conditions set out in the following truth table:

| P | Q | V | B |
|---|---|---|---|
| 0 | 0 | 0 | 0 |
| 1 | 0 | 1 | 0 |
| 0 | 1 | 0 | 1 |
| 1 | 1 | 0 | 0 |

Figure 2:
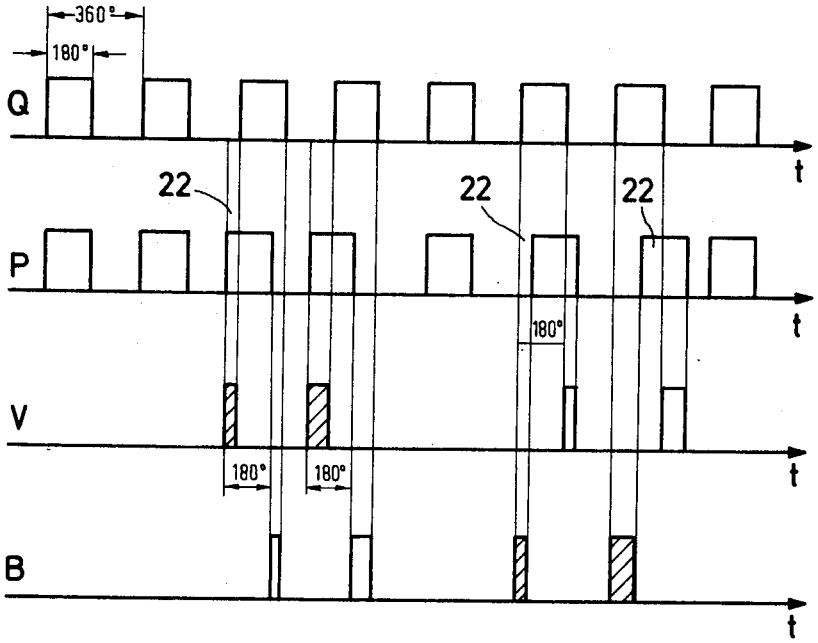
FIG. 2 shows a graph which illustrates the quartz oscillation pulses Q, the pendulum pulses P, the delay pulses V, and the acceleration pulses B one below another in a time sequence.

Therefore, if neither a quartz pulse Q nor a pendulum pulse P occurs at a given moment, then neither a delay pulse V nor an acceleration pulse B is formed (see also FIG. 2). On the other hand, a delay pulse is produced when a pendulum pulse occurs but not a quartz pulse, whereas an acceleration pulse is produced with the reverse situation. If both a pendulum pulse and a quartz pulse are present, no initial pulse is produced.

The cross-hatched delay or acceleration pulses 22 in FIG. 2 are thus produced in accordance with this truth table.

This truth table does however show that when the first pulse to occur disappears (FIG. 2 from left to right, the pendulum pulse P occurs first and then the quartz pulse Q) the reverse condition is present in each case so that the reverse pulse is produced at the end of the pulse in each case (in FIG. 2 first an acceleration pulse is produced and then a delay pulse).

Instead of suppressing these reverse pulses which, when using the simple structure of the correcting device described, would cancel the effect of the previous pulses again or at least lead to an undesirable consumption of current, they are fed to the control coil 15 in a similar manner to the other pulses which are directed in the opposite direction. Owing to the fact that the rectangular pulses each have identical positive and negative pulse lengths, the pulses which are not cross-hatched in FIG. 2 appear offset by 180° in relation to the other pulses in each case. In this position, the pendulum is, however, also offset by 180° in relation to the starting position so that the reverse pulse similarly has a correcting effect. Thus, despite the use of only a single control coil, correcting retardation or acceleration of the pendulum is effected at both its turning points.

It should be noted that the electronic devices can be designed particularly simply and reliably owing to the separation of sensor coil from the control coil. Apart from the inductive sensor described, other types of contact-free sensors can be used, for example sensors having a capacitive, optical/electrical or similar action. It is also possible to arrange the control coil in other ways, for example beneath the pendulum. It is however advantageous to design the electro-mechanical converter so that it acts at least at the two turning points, i.e. preferably over the entire oscillation of the pendulum. It is possible to utilise the control signals produced to an optimum in this case.

FIG. 1 shows that the current of the quartz oscillator 18 for exciting its oscillation is supplied from a battery 23 via a disconnecting device 24. The disconnecting device, like the amplifier/trigger 21, is connected to the sensor coil 16 and thus receives the sensor signal. The disconnecting device contains an integrating member formed of a combination of a capacitor and a resistor (in practice the input resistor of the amplifier). An integrating member with a relatively high time constant of about five minutes is thus created. The capacitor is charged when the sensor signal, i.e. the periodic pendulum pulse, is present. In this state, a trigger 25 is rendered conductive and the quartz oscillator 18 receives supply voltage.

If, however, the pendulum remains stationary so that the pendulum frequency is zero, the capacitor discharges via the relatively high resistance. In this state, the trigger 25 is rendered non-conductive and the quartz oscillator no longer receives supply voltage. The pendulum frequency and quartz frequency are thus both equal to zero so that neither a delay nor an acceleration signal is produced when the electronic devices are ready for further operation, i.e. virtually no energy is consumed.

When the pendulum starts up again, for example through winding up the clock which has stopped, the capacitor charges again via the disconnecting device, the trigger 25 becomes conductive and the correcting device functions again. The electronic devices are not therefore themselves disconnected but only the quartz oscillator so that there is adjustment between the frequency of the quartz oscillator and the frequency of the pendulum and the correcting device determines conformity of the two signals.

It should also be noted that despite the asymmetry which is indicated in the embodiment with the one-sided arrangement of the control coil, no disadvantages arise as regards the correcting behaviour.

I claim:

1. A mechanically operating pendulum clock, provided with an electronic correcting device comprising:

a quartz oscillator;

an electronic frequency divider which generates a frequency equal to that of the pendulum from the oscillation frequency of the quartz oscillator;

a permanent magnet arranged on the pendulum;

a control coil forming an electro-mechanical converter with an electro-magnet, the control coil being energizable at least in the two turning positions of the pendulum;

a contact-free pendulum sensor; and, a proportional electronic control device having a converter which produces rectangular signals from the signals emitted by the quartz oscillator and the sensor, and a comparator which is adapted, depending upon the reciprocal phase position of the quartz oscillator and sensor signals, to transmit delay or acceleration signals and opposing acceleration or delay signals to the control coil, the opposing signals being phase-shifted by 180°, whereby the correcting device is effective at least in the two turning positions of the pendulum.

2. A clock according to claim 1, wherein the contact-free sensor coil is separate from the control coil.

3. A clock according to claim 1, wherein the control coil has an axial length and the permanent magnet penetrating into it remains in its immediate vicinity throughout the entire movement of the pendulum.

4. A clock according to claim 1, further comprising a disconnecting device for rendering the correcting device ineffective when the pendulum is stationary.

5. A clock according to claim 4, wherein the disconnecting device is adapted to disconnect the quartz oscillator.

6. A clock according to claim 5, wherein the disconnecting device comprises an integrating member which causes disconnection of a current supply to the quartz oscillator if the pulses generated by movement of the pendulum are absent for a prolonged period.

* * * * *